US010549570B2

(12) United States Patent
Thies et al.

(10) Patent No.: US 10,549,570 B2
(45) Date of Patent: Feb. 4, 2020

(54) WRITING, DRAWING, MARKING AND/OR PAINTING UTENSIL OR COSMETICS IMPLEMENT OR INPUT DEVICE FOR CONTACT-SENSITIVE SURFACES, AND METHOD FOR PRODUCING THE SAME

(71) Applicant: STAEDTLER Mars GmbH & Co. KG, Nuremberg (DE)

(72) Inventors: Andreas Thies, Effeltrich (DE); Markus Handfest, Brampton (CA)

(73) Assignee: STAEDTLER MARS GMBH & CO. KG, Nürnberg (DE)

( * ) Notice: Subject to any disclaimer, the term of this patent is extended or adjusted under 35 U.S.C. 154(b) by 0 days.

(21) Appl. No.: 15/943,102

(22) Filed: Apr. 2, 2018

(65) Prior Publication Data

US 2018/0222244 A1 Aug. 9, 2018

Related U.S. Application Data

(63) Continuation of application No. 15/323,293, filed as application No. PCT/EP2015/001275 on Jun. 24, 2015, now Pat. No. 10,059,142.

(30) Foreign Application Priority Data

Jul. 2, 2014 (DE) ..... 10 2014 010 308

(51) Int. Cl.
*B43K 19/00* (2006.01)
*B43K 27/00* (2006.01)
(Continued)

(52) U.S. Cl.
CPC ..... *B43K 27/006* (2013.01); *A45D 40/20* (2013.01); *B43K 5/005* (2013.01); *B43K 7/005* (2013.01);
(Continued)

(58) Field of Classification Search
CPC ..... B43K 19/14; B43K 19/16; B43K 8/003; B43K 7/005; B43K 5/005; B43K 21/006
See application file for complete search history.

(56) References Cited

U.S. PATENT DOCUMENTS 3,993,408 A 11/1976 Arons
6,572,295 B1 6/2003 Chochoy
(Continued)

FOREIGN PATENT DOCUMENTS

DE 20116363 U1 2/2000
DE 29908890 U1 2/2000
(Continued)

*Primary Examiner* — Jennifer C Chiang
(74) *Attorney, Agent, or Firm* — Lucas & Mercanti, LLP; Klaus P. Stoffel

(57) ABSTRACT

A writing, drawing, marking and/or painting utensil or cosmetics implement or input device for contact-sensitive surfaces, wherein the utensil/implement/device includes at least one shank element made of plastics material or a plastics-containing wood substitute. The at least one shank element has a surface, or in that the at least one shank element has a surface which is sheathed in a material layer having a cover surface. The surface of the shank element or the cover surface of the material layer is in the form of a haptic and/or non-slip layer. The haptic and/or non-slip layer has a structure formed in one piece with the shank element and/or the material layer. The structure is formed by corrugation.

14 Claims, 4 Drawing Sheets

(51) Int. Cl.

| | |
|---|---|
| ***A45D 40/20*** | (2006.01) |
| ***B43K 8/00*** | (2006.01) |
| ***B43K 19/14*** | (2006.01) |
| ***B43K 19/16*** | (2006.01) |
| ***B43K 21/00*** | (2006.01) |
| ***B43K 5/00*** | (2006.01) |
| ***B43K 7/00*** | (2006.01) |

(52) U.S. Cl.
CPC ..... *B43K 8/003* (2013.01); *B43K 19/14* (2013.01); *B43K 19/16* (2013.01); *B43K 21/006* (2013.01)

(56) References Cited

U.S. PATENT DOCUMENTS

| | | | |
|---|---|---|---|
| 6,837,637 | B1 | 1/2005 | Beck |
| 6,848,851 | B2 | 2/2005 | Yokouchi |
| 7,351,469 | B2 | 4/2008 | Beck |
| 8,349,411 | B2 | 1/2013 | Beck |
| 8,747,003 | B2 | 6/2014 | Thies |
| 2015/0367673 | A1 | 12/2015 | Thies |

FOREIGN PATENT DOCUMENTS

| | | | |
|---|---|---|---|
| DE | 202004004010 | U1 | 5/2004 |
| DE | 102010030539 | A1 | 12/2011 |
| DE | 102010056239 | A1 | 4/2012 |
| EP | 1366929 | A1 | 12/2003 |
| EP | 2447051 | A1 | 5/2012 |

WRITING, DRAWING, MARKING AND/OR PAINTING UTENSIL OR COSMETICS IMPLEMENT OR INPUT DEVICE FOR CONTACT-SENSITIVE SURFACES, AND METHOD FOR PRODUCING THE SAME

CROSS-REFERENCE TO RELATED APPLICATIONS

The present application is a Continuation Application of U.S. patent application Ser. No. 15/323,293, filed Dec. 30, 2016, which is a 371 of International Application PCT/EP2015/001275 filed on Jun. 24, 2015 which claims the benefit of priority from German Patent Application No. 10 2014 010 308.0 filed Jul. 2, 2014, the contents of each of which are incorporated herein by reference.

BACKGROUND OF THE INVENTION

The invention relates to writing, drawing, marking and/or painting utensils or cosmetic implements or input devices for touch-sensitive surfaces formed from plastic material or plastic-containing wood substitutes, which have a particular external shaping, as well as to a method for their production.

Writing, drawing, marking and/or painting utensils or cosmetic implements or input devices for touch-sensitive surfaces with a surface which exhibits a particular effect are known in principle.

Writing, drawing, marking and/or painting utensils or cosmetic implements or input devices for touch-sensitive surfaces which are produced by means of extrusion always have a constant cross-sectional profile over their entire length. The cross-sectional profiles may differ substantially in their geometry or be configured in different manners. When produced in this manner, however, differences perpendicular to the direction of extrusion such as, for example, depressions or raised structures cannot be produced in an uninterrupted or continuous process. It has been shown that depressions or structures of this type have a pleasant tactile sensation for the user and thus are an important component of utensils of this type.

Thus, for example, a writing utensil which requires a subsequent machining process in order to generate bumps is known from DE 299 08 890 U1. Utensils of that type have bumps formed from an aqueous dispersion of plastic material which improve the utensil from an ergonomic or tactile viewpoint. A configuration of that type is intended to prevent user fatigue when the utensil is used for a long time.

The disadvantage with utensils of that type is that the bumps which are applied have to be applied subsequently, i.e. in a separate and additional working step, from an aqueous dispersion of plastic material. Furthermore, the bumps, which are applied in a liquid or paste form, first have to be hardened after application or deposition. This impedes a continuous process and as a result, increases the production costs for a utensil of that type. Moreover, disadvantageously, the applied bumps easily wear off during use and so they constitute an unattractive external detail element and furthermore lose their positive properties as regards the ergonomic advantages.

Writing, drawing, marking and/or painting styluses which have a slip-resistant surface are also known from DE 201 16 363 U1. Pencils of that type are coated with a special paint which is supposed to render the surface slip-resistant and provided it with good grip. Furthermore, the production is claimed to be technically simple and economical.

The disadvantage with writing, drawing, marking and/or painting styluses of this type is that although they have an appealing tactile surface, they do not have a raised structure which could also make the surface appearance more visible. This informs the user that the utensil is one with the usual smooth surface which is not slip-resistant.

Writing, drawing, marking and/or painting utensil shafts which are formed in one piece are known from DE 10 2010 030539 A1. In this regard, the surface of the shaft element is heated with a laser, which means that the plastic which is heated protrudes out of the surface of the shaft element because of a change in the volume.

The disadvantage here is that the process described demands a great deal of energy, and in addition is difficult to control. Each individual structure which is to be produced has to be programmed individually. Furthermore, in parts the energy input from the laser beam is too high, whereupon burning may occur on parts of the utensil shaft.

SUMMARY OF THE INVENTION

Thus, the object of the invention is to provide a writing, drawing, marking and/or painting utensil or cosmetic implement or input device for touch-sensitive surfaces which does not suffer from the disadvantages mentioned above and which in particular has an advantageous tactile surface which can be produced in a continuous process and which is visibly distinctive to the user without altering the primary properties, for example ease of sharpening, coloration, strength, coverage and erasability of the utensil.

Furthermore, a method is to be provided by means of which structures can be formed perpendicular to the direction of extrusion without having to employ a separate or additional machining process which produces cuttings or another preparation process.

The object is accomplished by means of a writing, drawing, marking and/or painting utensil or cosmetic implement or input device for touch-sensitive surfaces in which a visually discernible raised surface is applied to the shaft element of the utensil in order to improve the tactile properties by means of a corrugator, and thus the method means that the corrugation is formed as one piece with the utensil.

The term "corrugation process" should be understood to mean the subsequent treatment of an extruded rod with what is known as a corrugator. A process of this type for plastic pipes is known, for example, from DE 10 2010 056239 A1. In the known method, a freshly extruded rod formed from plastic is drawn into a corrugator in which that rod then runs through shaping jaws of the corrugator, thus producing a waved structure which corresponds to the design of the shaping jaws. In that process, the plastic rod is compressed into the cavities in the shaping jaws. This can be achieved or supported by a vacuum, for example.

Surprisingly, it has been shown that because of the corrugation of a solid body in the form of a writing, drawing, marking and/or painting utensil or cosmetic implement or input device for touch-sensitive surfaces, a surface which is antislip can be formed on the shaft element of the utensil, either directly and/or on a material layer which at least partially covers the shaft element, without having to interrupt the production process thereby. Advantageously, geometries can be produced which would otherwise only be able to be produced by further operations or injection molding. In addition, the desired properties, namely ease of sharpening, coloration, strength, coverage, erasability etc., are not affected thereby. Furthermore, it is advantageous that utensils can be produced by this process in which the structures and the basic construct is configured in the form of a one-piece shaft, which prevents loosening of the tactile and/or antislip layer or structures from the shaft element or basic construct. By forming a tactile and/or antislip surface or layer in this manner, a utensil produced in this manner has better tactile properties. It is immediately clear to the user from the raised structure that the utensil which has a particular tactile and/or antislip surface would feel comfortable during use. Thus, it is possible to use it for longer periods without becoming fatigued.

The writing, drawing, marking and/or painting utensil or cosmetic implement or input device for touch-sensitive surfaces in accordance with the invention has at least one shaft element formed from plastic material or plastic-containing wood substitute. The at least one shaft element has a surface, or a surface which is sheathed with a material layer having a covering surface. The surface of the shaft element or the covering surface of the material layer is formed as a tactile and/or non-slip layer, wherein the tactile and/or non-slip layer has a structure which is formed as one piece with the shaft element and/or the material layer. The structure built up on the utensil is formed by corrugation.

The at least one shaft element which has been described is present as a rod preform which is formed by extrusion.

The at least one shaft element may also comprise a material layer applied by transverse extrusion.

In the claimed embodiments, the plastic material and/or the plastic portion in the wood substitute of the shaft element is a thermoplastic. The material layer applied by transverse extrusion consists of at least one plastic material and/or at least one wood substitute comprising a plastic material, wherein the plastic material is formed as a thermoplastic.

The shaft element and/or the material layer covering the shaft element may also be expandable in constitution, which is of advantage for the production of raised structures. The expandable shaft element and/or material layer may comprise hollow microbeads.

The utensil in accordance with the invention or the rod preform or rod preform with material layer is produced by means of cascade extrusion.

The surface of the at least one shaft element consists of a plastic material which can be corrugated, wherein the corrugatable plastic forms the outer structured, tactile and/or antislip layer of the utensil. Alternatively, a deformable material layer is applied to the at least one shaft element which, when corrugation is carried out, forms raised structures which form the outer structured, tactile and/or antislip layer of the utensil.

The utensils formed in this manner may constitute a pencil or colored pencil which comprises at least one refill, at least one bonding agent and at least one shaft element.

The utensil may also be constituted by a fine lead pencil which comprises at least one fine lead, at least one lead tube and at least one shaft element.

In addition, the utensil may constitute a ball-point pen, a fibre-tip pen or a marker. In this regard, the utensil comprises at least one paste or ink reservoir and at least one shaft element.

When the utensil comprises at least one shaft element and at least one compartment, the at least one shaft element has a hollow profile, wherein at least one compartment is formed or disposed therein for a writing medium. In this case, the compartment is radially delimited by the at least one shaft element.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
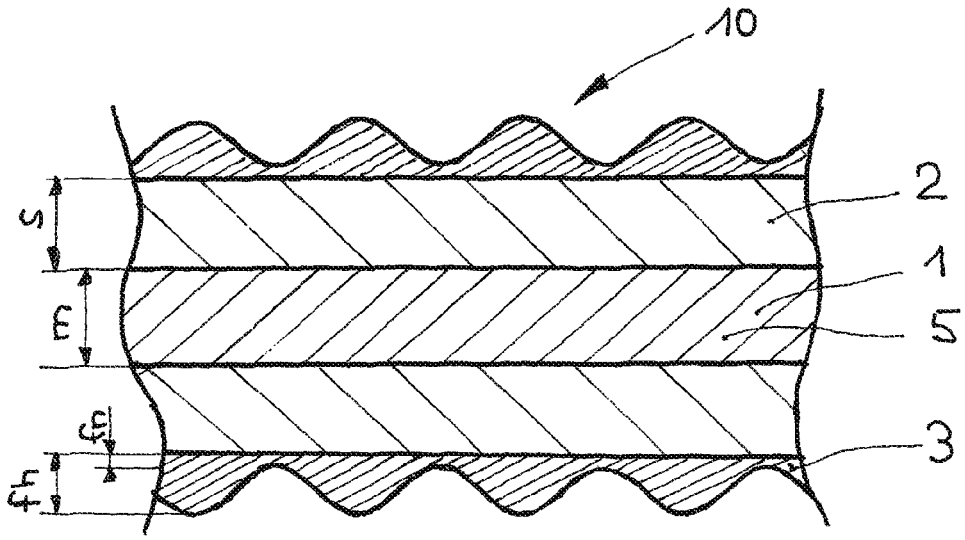
FIG. 1: shows a longitudinal section perpendicular to the transverse axis through a utensil in accordance with the invention.

FIG. 1 shows a longitudinal section through a writing, drawing, marking and/or painting utensil or cosmetic implement or input device for touch-sensitive surfaces 10 in accordance with the invention, which comprises a lead 1 in the center with a diameter m which is surrounded by a shaft element 2 with the wall thickness s. The shaft element 2 may, for example, be formed from plastic material or a plastic-containing wood substitute. The lead 1 is disposed in a compartment 5. On the outside of the shaft element 2 is a deformable material layer 3 with a minimum wall thickness fn and a maximum wall thickness fh. The height of the structures is given by the difference between the wall thicknesses fh and fn. The structures are produced by means of the corrugation process.

Figure 2:
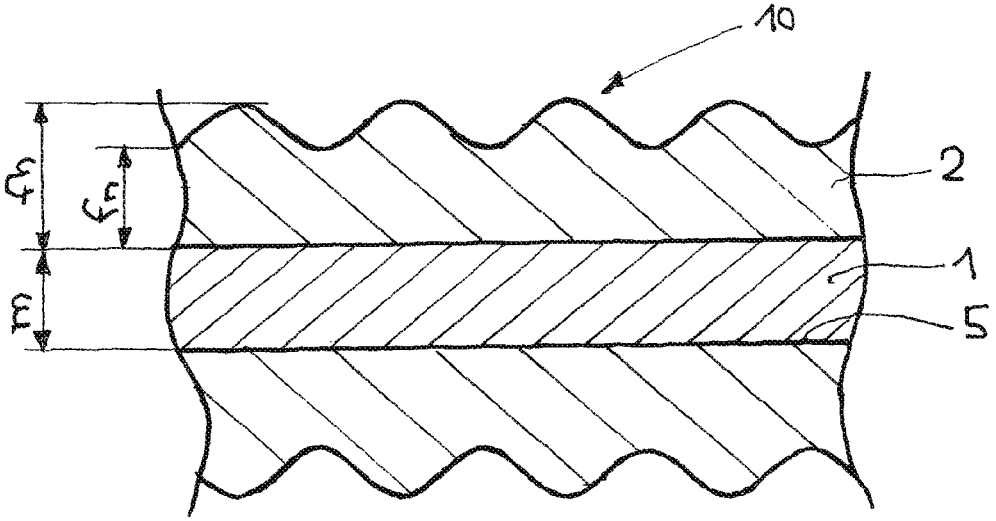
FIG. 2 shows a longitudinal section perpendicular to the transverse axis through another embodiment of a utensil in accordance with the invention.

FIG. 2 shows a longitudinal section through a further embodiment of a utensil 10 in accordance with the invention, which comprises a lead 1 in the center with a diameter m which is surrounded by a shaft element 2. The lead 1 is disposed in the compartment 5. The shaft element 2 must be formed from a material which can be extruded and, after completion of the extrusion, must also be at a temperature which is appropriate for deforming operations. In this manner, the shaft element 2 may be formed from plastic material or plastic-containing wood substitute, for example. The shaft element 2 can be deformed by corrugation and has a minimum wall thickness fn and a maximum wall thickness fh.

Figure 3:
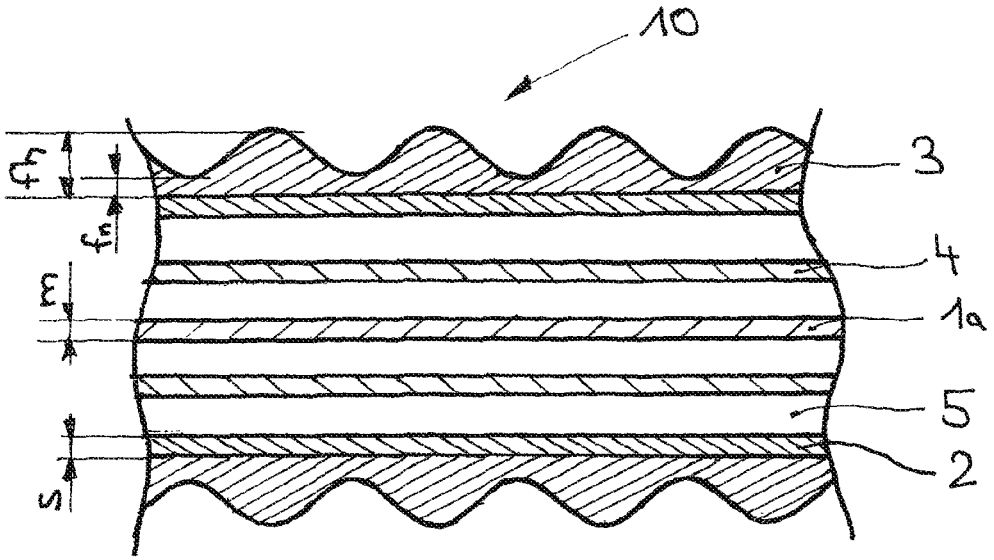
FIG. 3: shows a longitudinal section perpendicular to the transverse axis through a utensil in accordance with the invention in the form of a fine lead pencil.

FIG. 3 shows a longitudinal section through a utensil 10 in the form of a fine lead pencil which has at its center a fine lead 1*a* with a diameter m. The shaft element 2 with wall thickness s surrounds the lead tube 4 with wall thickness r in which the fine lead 1*a* is housed. The lead tube 4 with the fine lead 1*a* housed therein is disposed in the compartment 5. The shaft element 2 may, for example, be formed from plastic material or plastic-containing wood substitute. A deformable material layer 3 is disposed on the shaft element 2, which material layer has a minimum wall thickness fn and a maximum wall thickness fh.

Figure 4:
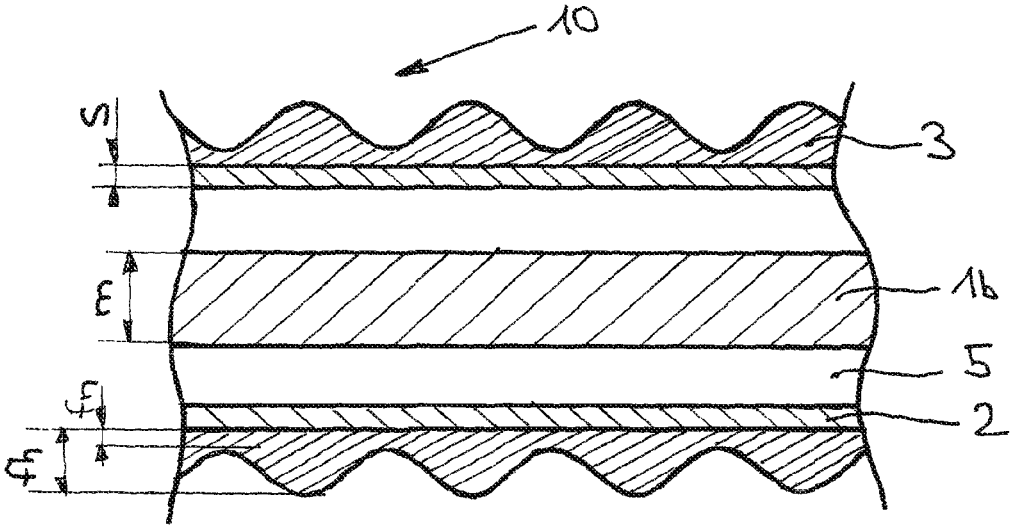
FIG. 4: shows a utensil in the form of a fibre-tip pen, in longitudinal section perpendicular to the transverse axis.

FIG. 4 shows a utensil 10 which has an ink reservoir 1*b* with diameter m in the center which is surrounded by the shaft element 2 with wall thickness s. The ink reservoir 1*b* is disposed in the compartment 5, wherein the compartment is limited radially outwardly by the shaft element 2. The shaft element 2 may, for example, be formed from plastic material or plastic-containing wood substitute. A deformable material layer 3 is disposed on the shaft element 2, which material layer has a minimum wall thickness fn and a maximum wall thickness fh, as already shown with respect to the preceding figures.

Figure 5:
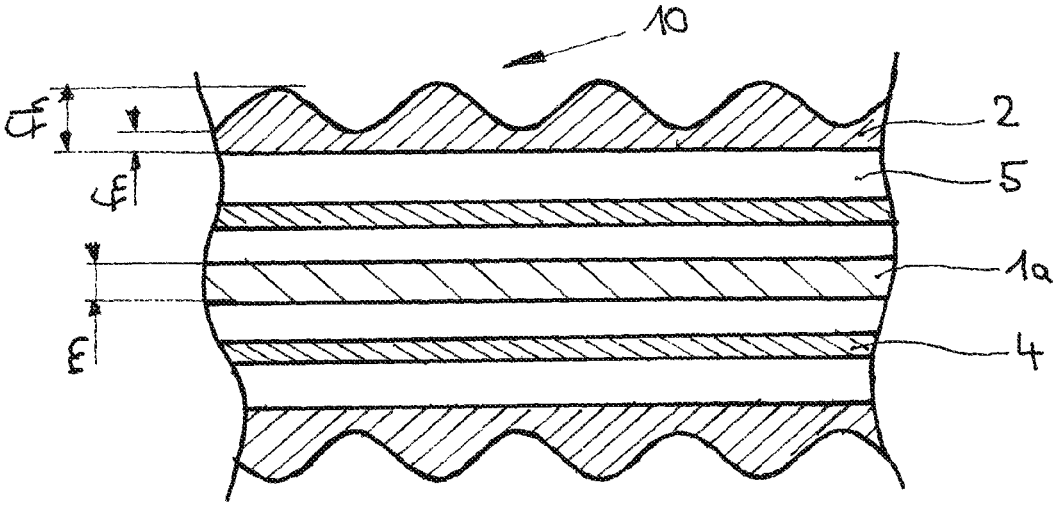
FIG. 5: shows a longitudinal section perpendicular to the transverse axis through a utensil in accordance with the invention.

FIG. 5 also shows a utensil 10 in accordance with the invention which has a fine lead 1*a* with diameter m in the center. The fine lead 1*a* is disposed in the lead tube 4. The lead tube 4 with the fine lead 1*a* disposed therein is itself disposed in the compartment 5. The shaft element 2 surrounds the lead tube 4 and must be formed from a material which can be corrugated. The shaft element 2 may, for example, be formed from thermoplastic plastic material or plastic-containing wood substitute which is shaped by corrugation and has a minimum wall thickness fn and a maximum wall thickness fh.

Figure 6:
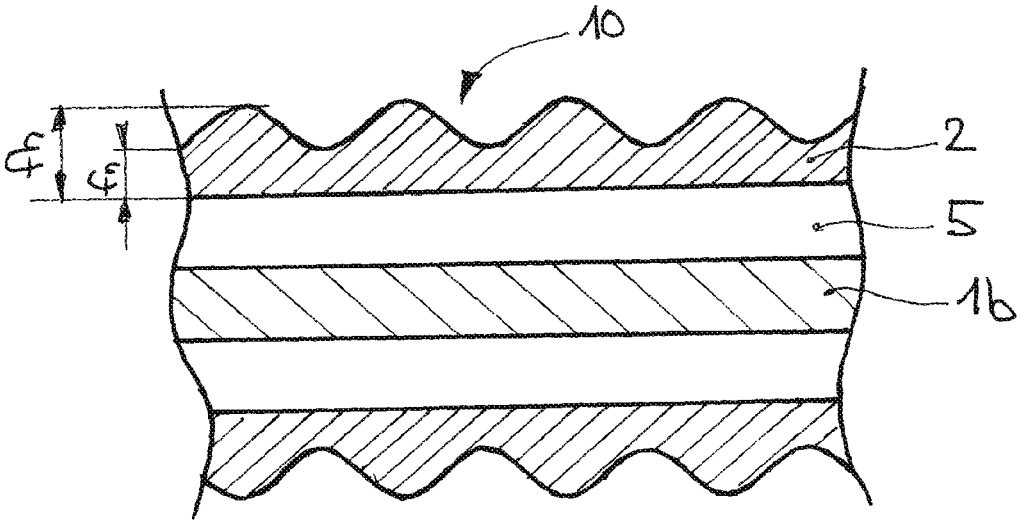
FIG. 6: shows a longitudinal section perpendicular to the transverse axis through a utensil in accordance with the invention.

The utensil 10 of FIG. 6 has an ink reservoir 1*b* in the center. The ink reservoir 1*b* is disposed in the compartment 5 in the usual manner with utensils of this type. The shaft element 2 surrounds the ink reservoir 1*b* and in this embodiment must also be formed from a material which can be corrugated. The shaft element 2 may, for example, be formed from plastic material or plastic-containing wood substitute. The shaft element 2 shaped by corrugation has a minimum wall thickness fn and a maximum wall thickness fh. The difference between the minimum and maximum wall thicknesses provides the shape of the raised structures.

Figure 7:
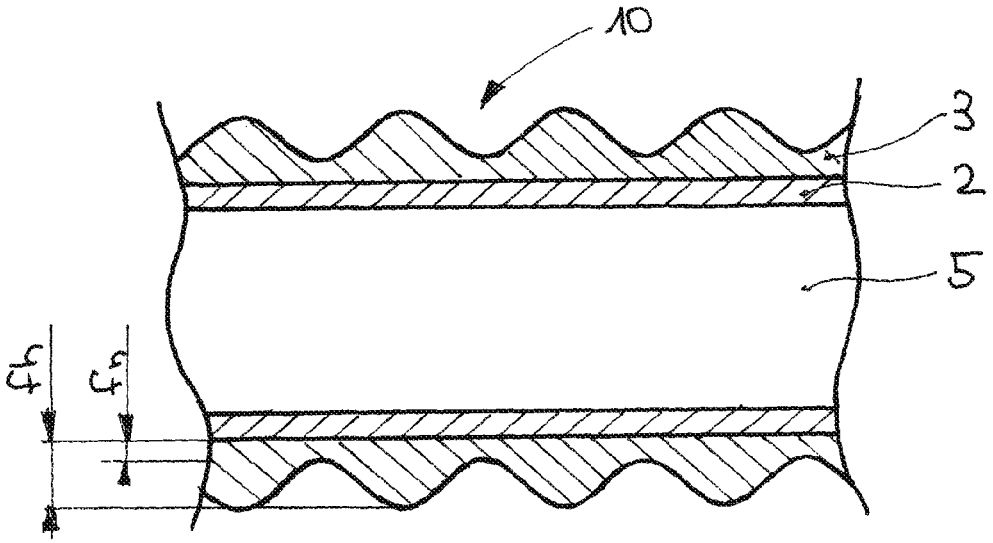
FIG. 7: shows a longitudinal section perpendicular to the transverse axis through a utensil in accordance with the invention.

FIG. 7 shows a further embodiment of a utensil 10. The utensil comprises a compartment 5 which is radially delimited by the shaft element 2 with a wall thickness s. The compartment 5, for example in the form of a shaft element, acts to accommodate any writing medium. The shaft element 2 may, for example, be formed from plastic material or plastic-containing wood substitute. The surface of the shaft element 2 is surrounded by a deformable material layer 3, wherein a minimum wall thickness fn and a maximum wall thickness fh are provided.

Figure 8:
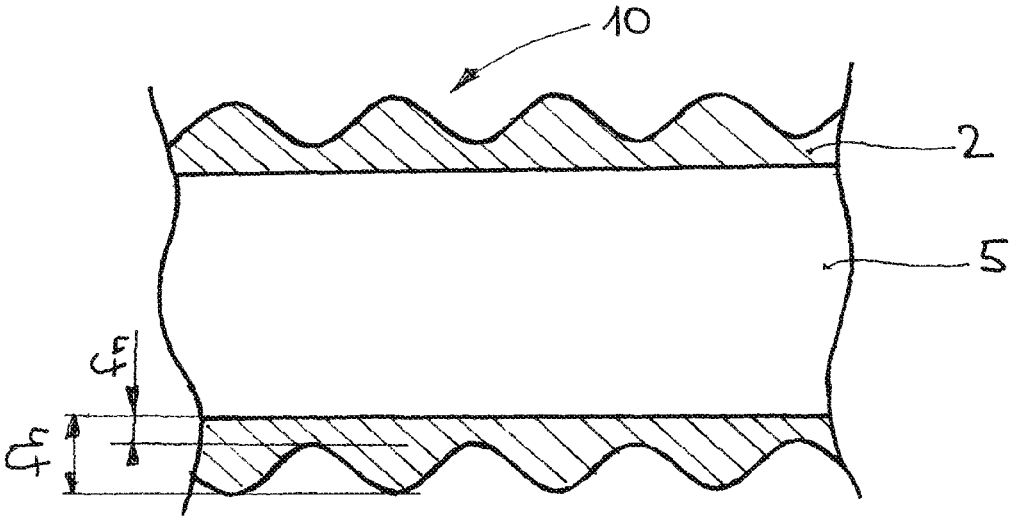
FIG. 8: shows a longitudinal section perpendicular to the transverse axis through a utensil in accordance with the invention.

In similar manner to FIG. 7, FIG. 8 shows a utensil 10 in accordance with the invention for accommodating any writing medium in the compartment 5, which has a compartment 5 in the center. The shaft element 2 surrounds the compartment 5 and in this embodiment has to be formed from a corrugatable material. The shaft element 2 may, for example, be formed from thermoplastic plastic or a wood substitute containing a thermoplastic plastic material. The shaft element 2 is shaped by corrugation and has a minimum wall thickness fn and a maximum wall thickness fh.

In accordance with the invention, any type of hollow profile may be produced with this method and thus be provided with an external raised structure. However, solid profiles or solid bodies may be provided with raised structures using the corrugation method.

The object of the invention is achieved by means of a method for the production of a writing, drawing, marking and/or painting utensil or cosmetic implement or input device for touch-sensitive surfaces which has a profiled surface.

Methods will now be described; in the first method, a utensil in the form of a solid body is produced, and in the second method, a hollow body is produced as a shaft element.

The method for the production of the utensil in accordance with the invention as a solid body comprises the following steps:

cascade extrusion, wherein a bare pencil, consisting of a lead, optional bonding agent and shaft element, is extruded into a rod preform, freezing the geometry of the rod preform by means of cooling, applying a deformable or corrugatable material layer to the rod preform by means of a second transverse extrusion, expanding the deformable material layer into the cavities of the corrugator.

This has proved effective when the at least one deformable material layer is a thermoplastic. The thermoplastic comprises at least one polymer from the group of polyolefins or styrene block polymers with chemical exo- or endothermic blowing agents.

Furthermore, particularly advantageously, the blowing agent is selected from the group comprising azodicarbinamide or oxybis benzenesulphonyl hydrazide.

During this corrugation, in contrast to the known corrugation art, a hollow body is not necessarily used, but rather a solid body. In this regard, the solid body is sheathed with a deformable layer so that only this layer expands into the cavities of the corrugator and thus only the outer structure of the utensil is altered by corrugation. It is thus not necessary to use a vacuum, which could possibly result in destruction of the internal structure of the pre-extruded utensil.

However, the method for the production of a utensil in accordance with the invention provided in the form of a hollow body or hollow profile can be described by the following steps:

extrusion of a shaft body in the form of a hollow profile into a rod preform, freezing the geometry of the rod preform by means of cooling, applying a deformable or corrugatable material layer to the rod preform by means of a second transverse extrusion, expanding the deformable material layer into the cavities of the corrugator.

As can be discerned from the descriptions in respect of FIGS. 2, 5, 6 and 8, the rod preform does not necessarily have to be coated with a material for the purposes of corrugation. Both for solid and for hollow bodies in the form of shaft elements, it is possible to introduce or produce the raised structures directly using the corrugation of the method. To this end, the shaft element must be formed from a thermoplastic material.

The methods in this regard are constituted as follows.

By means of cascade extrusion a raw rod consisting of a lead, optional bonding agent and shaft element, is extruded into a rod preform. On this rod preform, raised structures are produced by expansion or deformation of the still deformable thermoplastic material of the shaft element by means of the cavities of the corrugator.

Alternatively, a shaft body or shaft element formed as a hollow profile is produced by extrusion to form a rod preform. By expansion or deformation of the deformable shaft material into or through the cavities of the corrugatoror, raised structures are produced.

Depending on the extrusion head, the cross-section of the writing, drawing, marking and/or painting utensil or cosmetic implement or input device for touch-sensitive surfaces may assume a variety of shapes—round, angled or combinations thereof.

While specific embodiments of the invention have been shown and described in detail to illustrate the inventive principles, it will be understood that the invention may be embodied otherwise without departing from such principles.

We claim:

1. A writing, drawing, marking and/or painting utensil or cosmetic implement or input device for touch-sensitive surfaces, wherein the utensil comprises at least one shaft element formed from plastic-containing wood substitute, wherein the at least one shaft element has a surface, wherein the surface of the shaft element is formed as a tactile layer, wherein the tactile layer has a corrugation in the shaft element, wherein the at least one shaft element is an extruded rod preform, wherein a plastic material fraction in the wood substitute of the shaft element is a thermoplastic.

2. The utensil according to claim 1, wherein the at least one shaft element comprises a material layer applied by transverse extrusion.

3. The utensil according to claim 1, wherein the surface is sheathed in a material layer made of at least one plastic material and/or the wood substitute comprising at least one plastic material, wherein the plastic material is a thermoplastic.

4. The utensil according to claim 3, wherein the shaft element and/or the material layer are expandable.

5. The utensil according to claim 4, wherein the expandable material layer and/or the expandable shaft element comprises hollow microbeads.

6. The utensil according to claim 1, wherein the utensil is produced by cascade extrusion.

7. The utensil according to claim 1, wherein the surface of the at least one shaft element is of a plastic that can be corrugated, and the plastic that can be corrugated forms the outer structured, tactile layer of the utensil.

8. The utensil according to claim 1, wherein a deformable material layer is applied to the at least one shaft element, and the deformable material layer forms the outer structured, tactile layer.

9. The utensil according to claim 1, wherein the utensil is a pencil or a colored pencil, and the utensil comprises at least one lead, at least one bonding agent and the at least one shaft element.

10. The utensil according to claim 1, wherein the utensil is a fine lead pencil, and the utensil comprises at least one fine lead, at least one lead tube and the at least one shaft element.

11. The utensil according to claim 1, wherein the utensil is a ball point pen, a fiber-tip pen or a marker, and the utensil comprises at least one paste or ink reservoir and the at least one shaft element.

12. The utensil according to claim 1, wherein the utensil comprises the at least one shaft element and at least one compartment, the at least one shaft element has a hollow profile, a writing medium is disposed in the at least one compartment, and the at least one compartment is radially delimited by the at least one shaft element.

13. A method for producing a writing, drawing, marking and/or painting utensil or cosmetic implement or input device for touch-sensitive surfaces according to claim 1, comprising the steps of:

cascade extrusion, wherein a bare pencil, having a lead, optional bonding agent and a shaft element made of a plastic-containing wood substitute, is extruded into a rod preform; and expanding or deforming the shaft element into or through cavities of a corrugator.

14. A method for the production of a writing, drawing, marking and/or painting utensil or cosmetic implement or input device for touch-sensitive surfaces according to claim 1, comprising the steps of:

extruding of a shaft body in the form of a hollow profile into a rod preform made of a plastic-containing wood substitute, expanding or deforming a material layer into or through cavities of a corrugator.

* * * * *